United States Patent [19]

Hooper et al.

[11] 4,008,660

[45] Feb. 22, 1977

[54] MASTER LOADING AND UNLOADING APPARATUS FOR A LITHOGRAPHIC PRINTING MACHINE

[75] Inventors: Clinton Hooper, Brookfield; Joseph F. Miciukiewicz, Trumbull; Philip Pollak, Jr., Westport; John W. Bach, Stamford, all of Conn.

[73] Assignee: Pitney-Bowes, Inc., Stamford, Conn.

[22] Filed: Apr. 8, 1975

[21] Appl. No.: 566,145

[52] U.S. Cl. ..... 101/132; 101/409

[51] Int. Cl.[2] ..... B41F 7/00; B41F 21/04

[58] Field of Search ..... 101/130, 131, 132, 132.5, 101/140, 141, 142, 144, 409, 410, 411

[56] References Cited

UNITED STATES PATENTS

| | | | |
|---|---|---|---|
| 3,420,169 | 1/1969 | Gammeter | 101/141 |
| 3,779,162 | 12/1973 | Ogawa et al. | 101/142 |
| 3,793,950 | 2/1974 | Kaneko et al. | 101/142 |
| 3,858,508 | 1/1975 | Kaneko et al. | 101/142 |
| 3,861,306 | 1/1975 | DuBois | 101/132.5 |
| 3,871,294 | 3/1975 | Kagari et al. | 101/142 |
| 3,874,290 | 4/1975 | Suzuki | 101/132.5 |

*Primary Examiner*—Edgar S. Burr
*Assistant Examiner*—R. E. Suter
*Attorney, Agent, or Firm*—Martin D. Wittstein; William D. Soltow, Jr.; Albert W. Scribner

[57] ABSTRACT

An apparatus is disclosed for loading a master onto and unloading the master from the rotating master cylinder in a lithographic printing machine at substantially the same angular position of cylinder rotation. The apparatus includes external grippers for gripping a master edge and moving it into the proximity of the cylinder through a master delivery path. Internal grippers for gripping and later releasing the master edge in the proximity of the cylinder are mounted in the cylinder and are extendable beyond the cylinder surface during a first angular sector of cylinder rotation to describe a master receiving path that intersects the master delivery path in a loading merger region. The internal grippers are also extendable beyond the cylinder surface in a second angular sector of cylinder rotation to describe a master release path. A stripper chute for unloading the master from the cylinder is movable into the proximity of the cylinder to describe a master stripping path that intersects the master release path in an unloading merger region. These three master handling components are operated in coordinated fashion by related mechanisms which include a transfer actuator that operates the external grippers to grip a master edge and deliver it to and release it in the loading merger region. A load control mechanism selectively operates the internal grippers to traverse the master receiving path, grip the delivered master edge, and later traverse the master release path and release the master edge in the unloading merger region.

6 Claims, 13 Drawing Figures

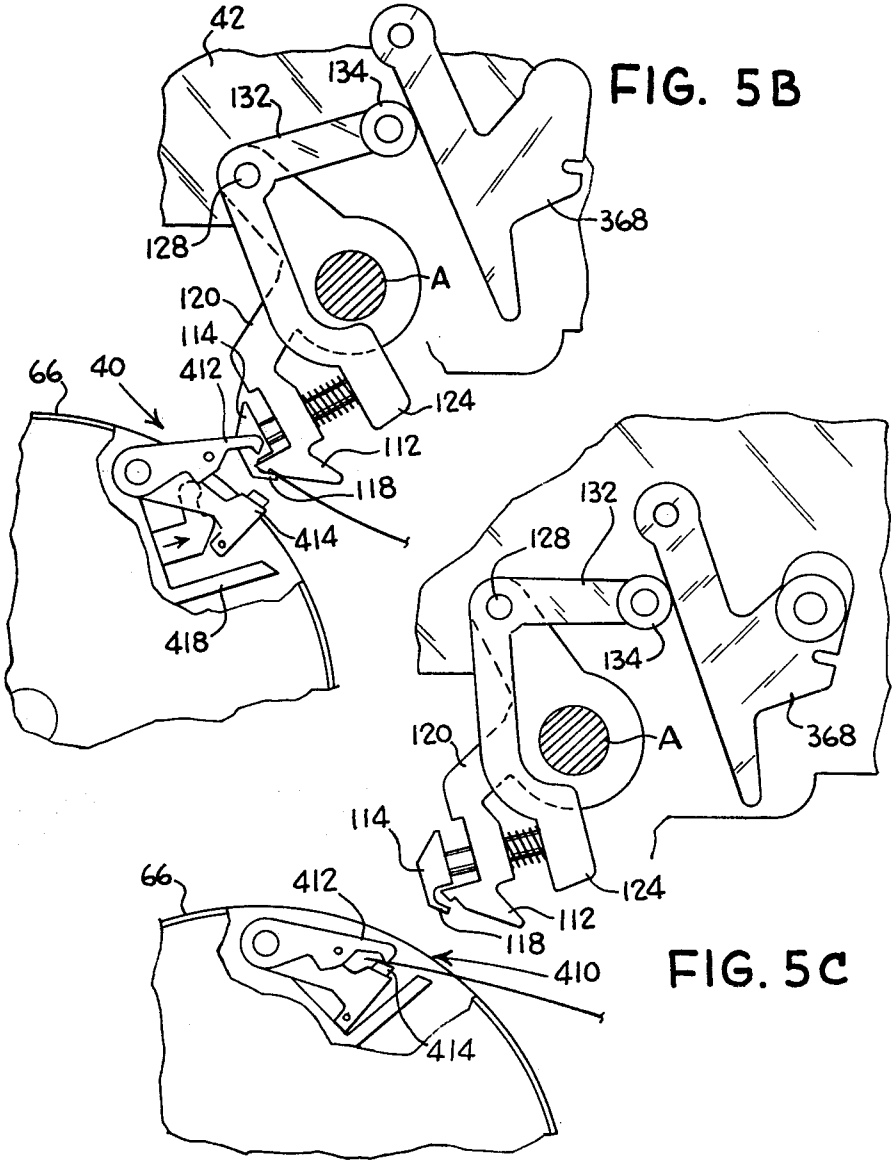
FIG. 5B
FIG. 5C
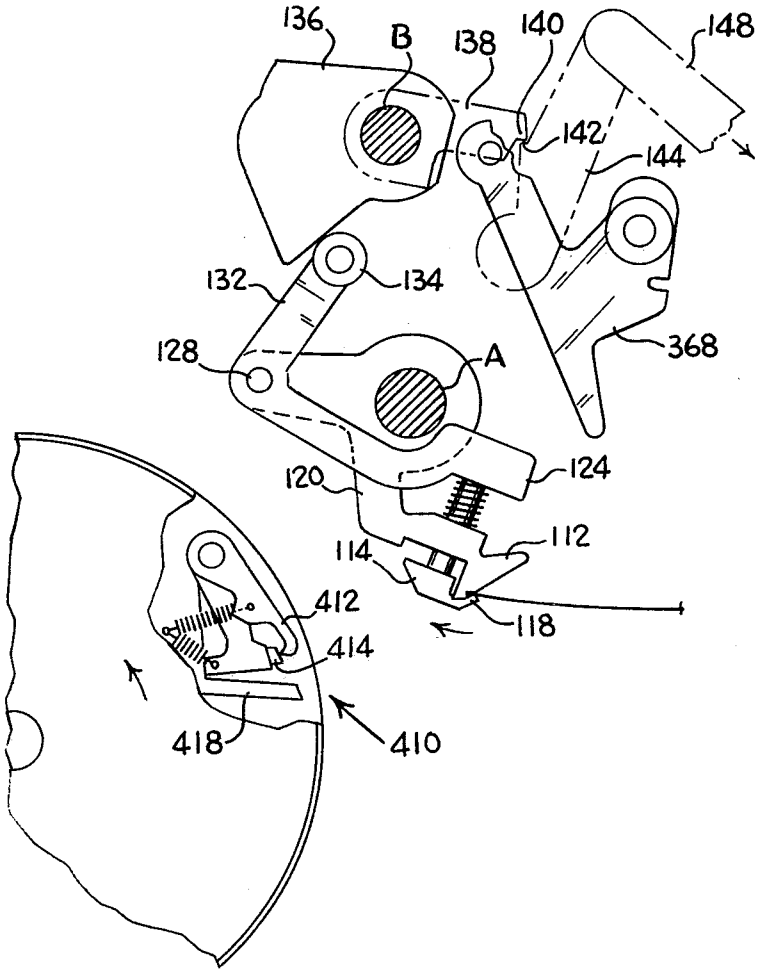
FIG. 5A

MASTER LOADING AND UNLOADING APPARATUS FOR A LITHOGRAPHIC PRINTING MACHINE

BACKGROUND OF THE INVENTION

1. Field of the Invention

The present invention relates to an apparatus for loading a master onto and unloading a master from the rotatable master cylinder of a lithographic printing machine.

In the lithographic printing process, a master of sheet material is first prepared so that it carries a latent image and is then treated so that the imaged areas are ink receptive, that is oleophilic, and the background areas are water receptive and ink repellent, that is hydrophilic. The treated master is applied to a rotating master cylinder or flat bed where moistening fluid and ink are applied to it. A copy sheet may then be pressed against the master to receive the inked image or the image may first be transferred to a blanket roll or plate against which the copy sheet is subsequently pressed to receive the image.

When the direct printing technique is used, the image carried on the master must be reversed to produce a copy which reads correctly. However, when the transfer technique, also called the offset printing technique, is used, the image carried on the master must be right-reading to produce a correctly reading copy.

Lithographic masters may be prepared as described above by any of a number of suitable processes. For example, in the past they have been manually prepared, and loaded and unloaded on the master cylinder by skilled personnel. Accordingly, such processes are relatively difficult and expensive to implement making them uneconomical unless an exceedingly large number of copies of any given master are required. However, it has recently been suggested in U.S. Pat. No. 3,861,306 (DuBois et al.) that lithographic masters be made by an electrostatic process where the master, in the form of a flexible sheet that includes a photoconductive coating, is mounted on an electrically conductive substrate which is uniformly, electrostatically charged. The master sheet is exposed to illumination in accordance with the image indicia on the document to be copied. The illuminated non-imaged master areas become discharged but the non-illustrated, image areas remain charged to form a latent electrostatic image that attracts and retains electroscopic toner particles which may be applied to the master sheet by various techniques.

An etching solution is applied to the master to render the non-image areas hydrophilic and a moistening fluid and lithographic ink are then applied to the master to produce a printable image. Finally, the master is loaded on to the master cylinder and copies are printed therefrom.

The electrostatic master production process may be conveniently automated, thus reducing the need for skilled printing machine operators. Accordingly, this process can be used with particular advantage when relatively small numbers of copies are made from one master, but many masters in a series are required. But to take full advantage of the benefits which result, it is also desirable to load and unload the masters on the master cylinder automatically, and continuously so that relatively short runs of documents can be made economically and efficiently.

The apparatus of the present invention is well suited for use with such lithographic printing machines where the master is electrostatically produced and where it is desirable to load onto and unload the master from a master cylinder in an automatic, continuous, uninterrupted way. However, this invention may be used equally advantageously with lithographic printing machines in which masters are produced by other techniques, but in which it is desirable to automatically load them onto and unload them from the master cylinder.

2. Description of the Prior Art

Automatic master handling apparatus for lithographic printing machines are known. U.S. Pat. No. 3,420,169 (Gammeter) discloses one such apparatus which employs a transfer gripper system that carries a master into the proximity of the master cylinder. A group of master gripper devices are mounted in the cylinder to be extended beyond the cylinder surface at two angularly spaced locations. The transfer gripper system accelerates the master to the peripheral speed of the cylinder and places the master directly in the jaws of the master gripper devices when they are extended beyond the cylinder surface at a first loading position. Subsequently, at a second unloading position rotationally offset with respect to the loading position, the master gripper devices extend beyond the cylinder surface to eject the master. Indeed, as illustrated in the patent drawing, the Gammeter apparatus loads and unloads the master from the cylinder at positions spaced approximately 180° cylinder rotation from each other.

In particular, since masters are loaded and unloaded at nearly diametrically opposed positions of the master cylinder, master handling equipment is mounted on both sides of the printing equipment. Therefore, this arrangement makes it difficult to provide separate modular master handling and printing instrumentalities.

U.S. Pat. No. 3,861,306 (DuBois et al.), noted above, discloses combined electrostatic-lithographic duplicating processes and apparatus. The apparatus described is of modular construction but no detailed disclosure of the loading and unloading apparatus is given.

Other prior lithographic printing machines and master handling apparatus are disclosed in U.S. Pats. Nos. 2,031,136 (Sewick); 2,177,578 (Neidich); 2,220,282 (Ritzerfeld); 2,252,204 (Reilly); 2,352,658 (Richmond et al.); 2,360,015 (Rockhill); 2,398,646 (Karbach et al.); 2,603,154 (Davidson); 2,642,282 (Backhouse); 3,153,380 (Gericke); 3,169,476 (Fielding); 3,190,645 (Reinarkz); 3,221,652 (Mestre); and 3,231,418 (Muggleton). These patents are generally related to such lithographic printing apparatus but are not considered to be as pertinent as the Gammeter and DuBois et al patents.

SUMMARY OF THE INVENTION

In the preferred embodiment of the present invention, to be described below in detail, the apparatus for loading and unloading a master is used with a lithographic printing machine having a rotatable master cylinder for holding the master thereon, means for applying printing fluids to the master, and means for receiving an impression from the fluids applied to the master. The apparatus loads the master onto and unloads the master from the master cylinder at substantially the same angular position of cylinder rotation, delivering the master to the cylinder from one direction and removing it from the cylinder in a second direction opposite and substantially parallel to the first. Therefore, this apparatus is particularly well suited for modular construction since it may be installed on one side of a similarly, modularly constructed lithographic printing apparatus to deliver a master thereto and retrieve a master therefrom.

In the preferred embodiment, the present invention comprises a series of external grippers for gripping an edge of a master, which are movable through a master delivery path to deliver the master edge into the proximity of the master cylinder. A series of internal grippers are mounted in the cylinder to rotate with it, to grip the master edge delivered into the proximity of the cylinder, and to later release the master edge. These internal grippers are extendable beyond the cylinder surface during a first angular sector of cylinder rotation to describe a master receiving path that intersects the external gripper master delivery path in a loading merger region. The internal grippers are further extendable beyond the cylinder surface during a second angular sector of cylinder rotation to describe a master release path.

A stripper chute, for unloading the master from the cylinder, is movable into the proximity of the cylinder to define a master stripping path that intersects the internal gripper master release path in an unloading merger region.

Interrelated actuator mechanisms operate the internal and external grippers and the stripper chute to load and unload the master. These mechanisms include a transfer actuator that operates the external grippers to grip a master edge, deliver the master edge to and release the master edge in the loading merger region. The internal grippers are selectively operated by a load control mechanism to extend beyond the cylinder surface in the first angular sector and grip the master edge released in the loading region. When use of the master has been completed, the load control mechanism operates the internal grippers to extend beyond the cylinder surface in the second angular sector to release the master edge in the unloading merger region.

In order to load and unload at substantially the same angular position of cylinder rotation, the internal grippers must be controlled to close at that position when receiving a master but to open at substantially that position when releasing the master. Therefore, the load control mechanism is designed to operate the internal grippers so that the second angular sector coincides at least in part with the unloading merger region. Further, the internal grippers can be controlled so that the loading merger region coincides at least in part with the unloading merger region.

The load control mechanism which accomplishes this objective includes a load control cam, which is mounted for pivoted movement between master receiving and master releasing positions, a load control cam follower, and a push rod that couples the load control cam follower to the internal grippers. When in either the master receiving or releasing positions the load control cam is non-rotatably fixed relative to the master cylinder. The cam is shaped to extend the internal grippers beyond the cylinder surface in the first angular sector when in the master receiving position and to extend the internal grippers beyond the cylinder surface in the second angular sector when in the master releasing position.

Just before the master is released by the internal grippers in the unloading merger region, the transfer actuator moves the stripper chute into the proximity of the cylinder to unload the master. The stripper chute is shaped to conduct the used master away from the cylinder in a direction substantially parallel but opposed to the direction along which the master is conducted to the cylinder.

The novel, pivotable load control cam arrangement and stripper chute shape permit loading and unloading of a master from the same side of the master cylinder and, hence, the same side of the lithographic printing apparatus. This invention, then, facilitates modular printing and master handling apparatus construction. A complicated mounting arrangement which would allow the master handling apparatus to straddle the lithographic printing apparatus is unnecessary. Similarly, two separate master handling mechanisms, one for loading from one side of the master cylinder and the other for unloading from the opposite side of the master cylinder are unnecessary.

Accordingly, it is an object of the present invention to provide apparatus well suited to modular construction for loading a master onto and unloading a master from a lithographic printing machine.

Other objects, aspects, and advantages of the present invention will be pointed out in, or will be understood from, a consideration of the detailed description provided below or in conjunction with the accompanying drawings.

BRIEF DESCRIPTION OF THE DRAWINGS

FIGS. 5A, 5B and 5C are side elevational views sequentially showing the leading edge of the master being delivered by the external grippers to the internal grippers mounted in the master cylinder.

DETAILED DESCRIPTION OF THE PREFERRED EMBODIMENT

A. The Master Producing, Handling, and Lithographic Printing Apparatus

Figure 1:
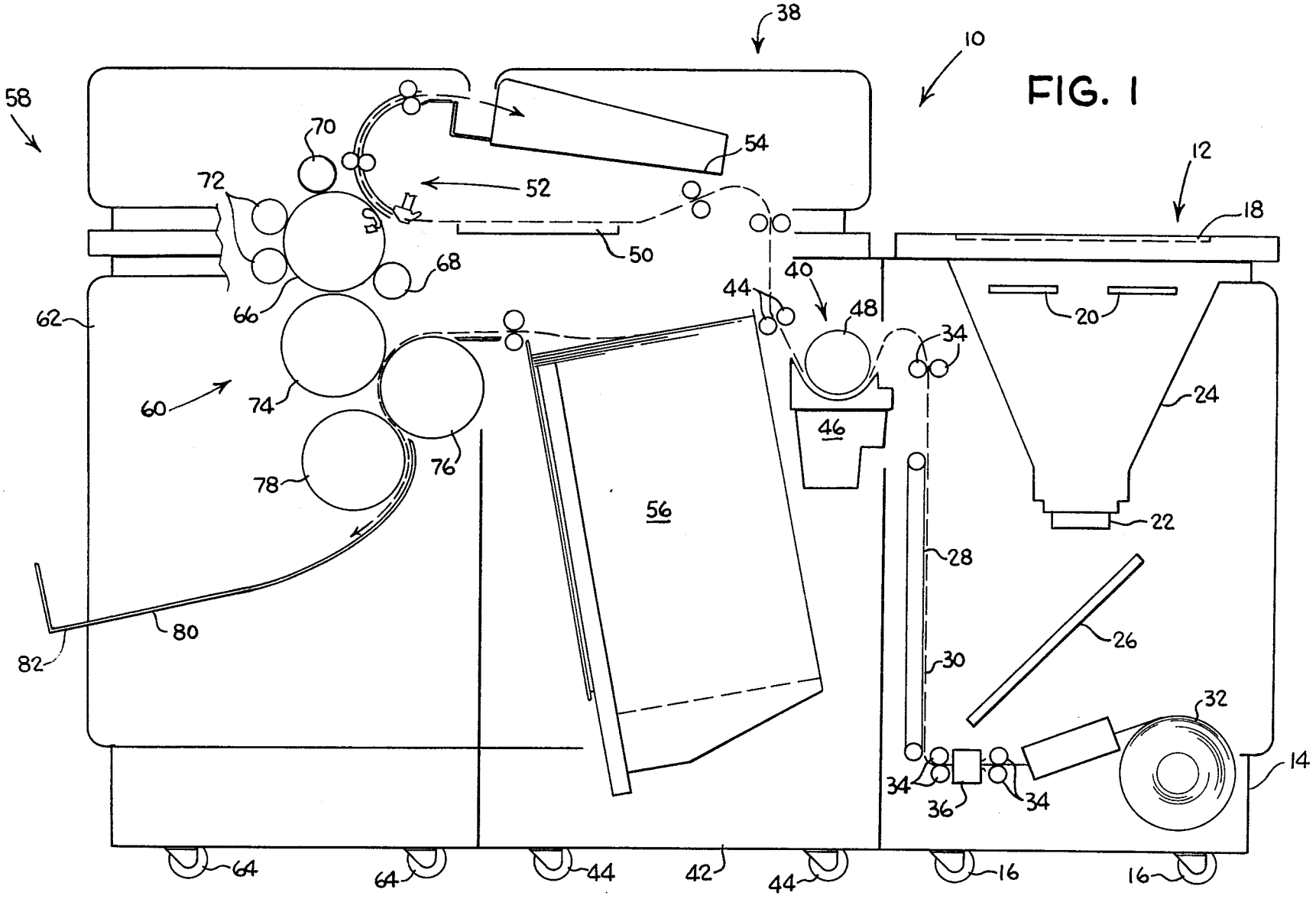
FIG. 1 is a diagrammatic side elevational view of a modular printing apparatus which includes a lithographic printing press, a copying apparatus, and a master loading and unloading apparatus constructed in accordance with the preferred embodiment of the present invention.

The master loading and unloading apparatus of the present invention may be used in conjunction with a duplicating machine 10 such as that disclosed in U.S. Pat. No. 3,861,306 (DuBois et al.). As shown in FIG. 1, the duplicating machine includes three separable modules, the first 12 of which is an electrostatic photocopying apparatus supported in a first upstanding, generally rectangular frame 14 that is mounted for easy movement on a number of casters 16. This photocopying apparatus 12 includes a transparent document window 18 and a plurality of high intensity lamps 20 disposed to illuminate a document placed on the window. A suitable lens 22, mounted in a box-like structure 24, focuses image indicia reflected from the document and from a planar mirror 26 onto an image plane 28.

A master 30 of sheet material, which originates from a supply roll 32, is conducted past the image plane 28 by a series of pairs of intermittantly driven feed rolls 34. The master 30 comprises a photoconductive material, such as zinc oxide, coated on an electrically conductive substrate, such as paper, and is fed through a charging device, for example a corona charger 36, which uniformly charges the master's photoconductive coating.

When the charged master is properly positioned on the image plane, the lamps 20 are energized to expose the master to a pattern of light corresponding to the image indicia on an original document received on window 18. This exposure causes the charge on the photoconductive coating to dissipate in the nonimage area leaving a latent electrostatic image on the master sheet image areas.

From the image plane 28, the master sheet 30 is fed to a second module 38 which includes a developing station, generally indicated at 40 supported in a second, generally rectangular frame 42 also mounted on casters 44. The developing station 40 has a tank 46 for holding a supply of liquid toner that carries oleophilic electroscopic particles which are attracted to the charged master image areas, and a rotating cylinder 48, for guiding the master into the tank. Two squeegee rolls 44 mounted upstream of the toner supply tank 40 wipe excess liquid from the master sheet after being immersed in the toner.

In addition to the developing station 40, the second frame 42 houses a master handling apparatus that includes a master orientation station 50, master loading and unloading apparatus 52, described in greater detail below, and master collection tray 54. Further, the second frame 42 supports a feed apparatus 56 that delivers, in conventional fashion, copy sheets to the lithographic printing press.

A third module 58 includes the lithographic printing press, generally indicated at 60, supported in a third upstanding, generally rectangular frame 62 mounted on casters 64. The printing press 60 includes a master cylinder 66 that holds the developed master against its cylindrical surface. An etching solution applicating roller 68 contacts the master cylinder surface to apply etching solution to the master sheet and thereby render it hydrophilic in the non-image areas.

After application of etching solution, the master sheet is rotated past a dampening roll 70 which applies a properly regulated amount of dampening solution. The master is rotated past two ink applying rollers 72 which apply a properly regulated amount of ink to the master during rotation of the master cylinder when application of the etching and dampening solutions has been completed. This sequential application of the various printing fluids causes the ink to adhere to the master only in the imaged areas developed with the oleophilic toner and accordingly results in a printable image.

The illustrated printing press 60 is of the offset type and, therefore, includes a blanket roll 74, mounted for rotation with its peripheral surface in contact with the surface of the master cylinder 66 so that rotation of the two transfers the inked image formed on the master sheet to the blanket roll 74. An impression roll 76 is mounted for rotation to receive sheets of copy paper from the copy sheet feed apparatus 56 and to have its peripheral surface in contact with the peripheral surface of the blanket roll 74. Therefore, the inked image carried on the blanket roll 74 is subsequently transferred to the copy paper as it passes through the nip of the blanket and impression rolls. Finally, a delivery roll 78, positioned adjacent the impression cylinder, operates to take the printed copy sheet therefrom and transfer it to a delivery chute 80 ultimately to be collected in a copy collection tray 82.

The present invention is directed to the apparatus 52 for loading the master onto and unloading the master from the master cylinder 66. As can be seen in FIG. 1, this apparatus 52 conducts the master from the orientation station 50 to the cylinder 66 in a leftward horizontal direction and unloads the master back rightward in similar, substantially horizontal direction. Thus, the master is not transferred through the printing press from one side of the third module 58 to the other, but rather is loaded and unloaded from only one side of the module 58.

This master loading and unloading apparatus 52 includes three basic master handling mechanisms, namely, an external gripper mechanism which transfers the master to the master cylinder; an internal gripper mechanism which holds the master received from the external gripper mechanism against the master cylinder and later releases the master from the master cylinder; and a stripper chute mechanism which removes the master and diverts it back into the master collection tray 54. The loading and unloading apparatus also includes various actuators for operating these master handling mechanisms.

B. The External Gripper Mechanism

FIGS. 2, 3, 5A through 5C, and 7 illustrate the external gripper mechanism generally indicated at 110, which receives a master at the master orientation station 50 and moves through a master delivery path (FIG. 11) to deliver the master into the proximity of the master cylinder 66.

Figure 3:
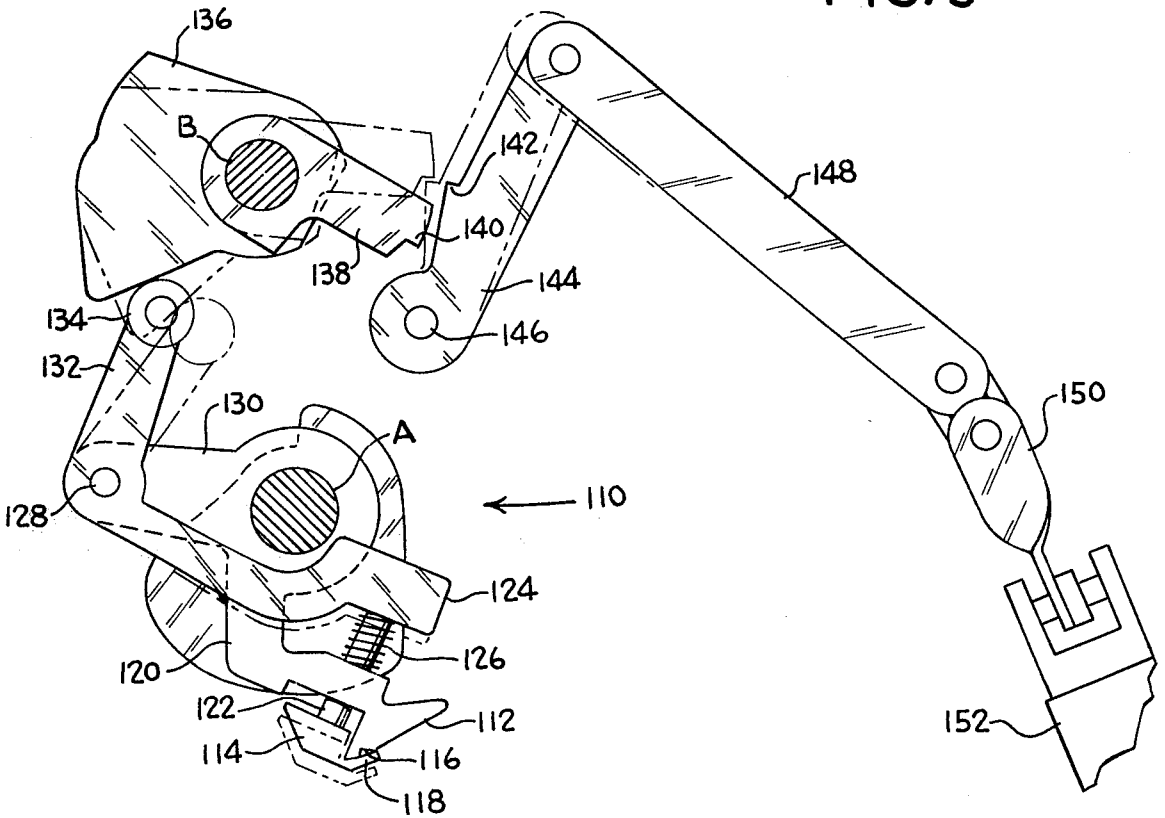
FIG. 3 is an enlarged side elevational view, similar to that of FIG. 2, of one set of external grippers showing the mechanism for closing them to grip the leading edge of a master.
Figure 7:
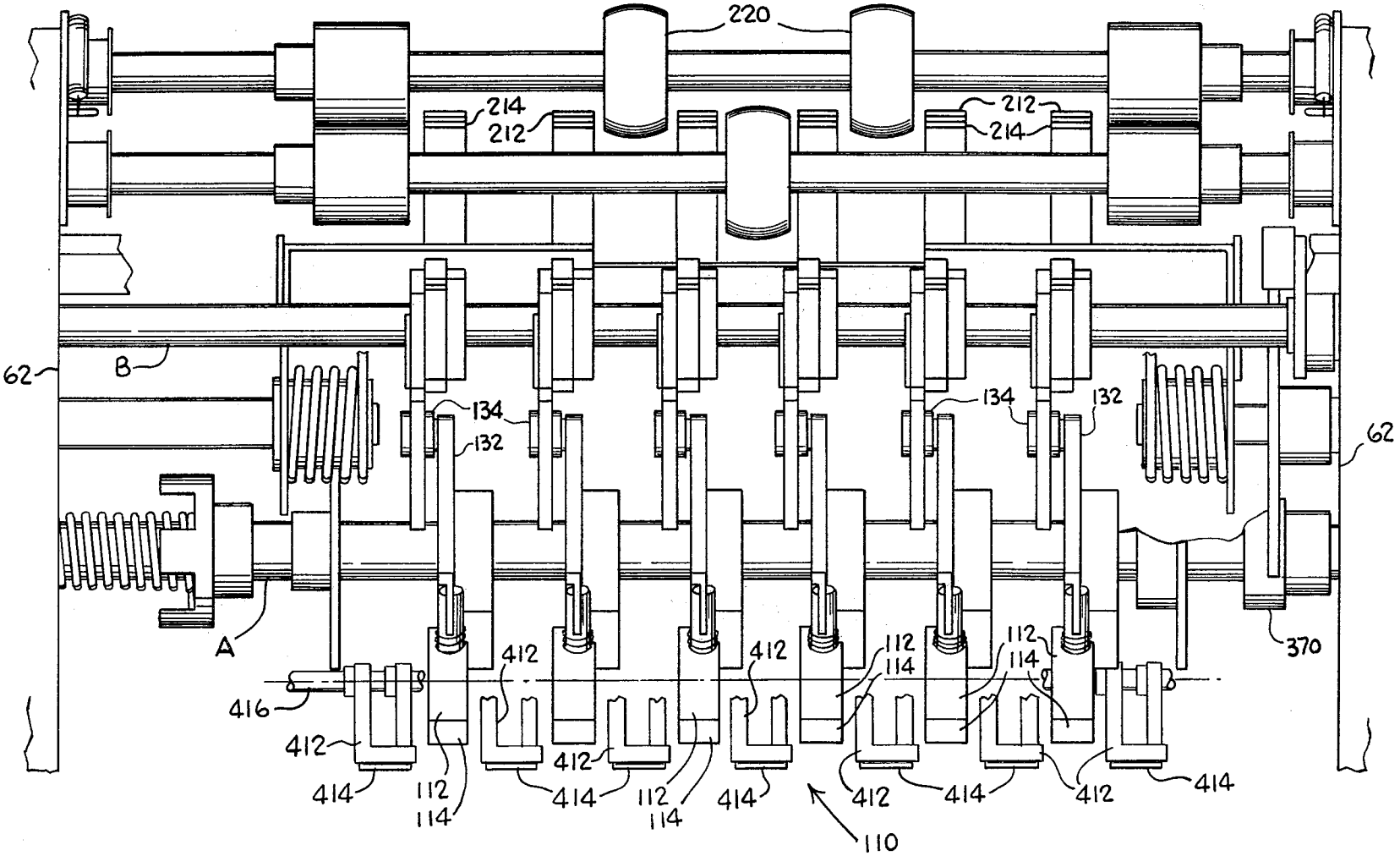
FIG. 7 is a top plan view partly broken away showing the horizontal relationship of the internal and external grippers and the stripper fingers of the stripper chute.

Referring first to FIGS. 3 and 7, the external gripper mechanism 110 comprises a plurality of opposing pairs of upper and lower gripper jaws 112 and 114 respectively mounted at uniformly spaced locations on a main shaft A that spans frame 62. As shown by solid lines, the upper gripper jaw is formed with a notch 116, which receives the lead edge of the master, and the lower gripper jaw is formed with an upwardly curled finger 118, which grips the received lead master edge when closed against the upper jaw.

The mounting arrangement for each pair of gripper jaws is illustrated in detail in FIG. 3. Each upper gripper jaw is formed with an arm 120 that is fixed to main shaft A to rotate therewith. Lower gripper jaw 114 is carried on a push rod 122 which is fixed in an actuator arm 124 that is pivoted on a shaft 128 mounted on a sidewardly projecting extension 130 of upper gripper jaw arm 120. A resiliant coil spring 126 is mounted on push rod 122 and is compressed between actuator arm 124 and arm 120 to urge lower gripper jaw 114 to the closed position. Accordingly, when actuator arm 124 pivots in a clockwise direction about shaft 128 against the bias of spring 126, lower gripper jaw 114 opens from upper gripper jaw 112. Conversely, when actuator arm 124 pivots in a counterclockwise direction about shaft 128, the external gripper jaw closes.

Actuator arm 124 further has a generally upwardly projecting extension 132 on which a cam follower 134 is rotationally mounted. Cam follower 134 is positioned to engage an external gripper jaw closing cam 136 which is fixed to a secondary shaft B to rotate therewith. A cam latch 138 is also fixed to shaft B and has a latch projection 140 which engages a mating catch surface 142 formed on catch link 144. Catch link 144 is pivoted on a fixed shaft 146 and when rotated in the clockwise direction releases catch 138 permitting gripper jaw closing cam 136 to similarly rotate in the clockwise direction. Therefore, cam follower 134 and actuator arm 124 can pivot in a counterclockwise direction allowing external gripper jaws 112 and 114 to close.

Catch link 144 is connected by a series of interconnecting links 148 and 150 to an actuator solenoid 152. The solenoid is energized by a photocell (not shown) which detects entry of a master into the master orientation station 50. A suitable delay is introduced between the actual reception of the master sheet in the orientation station and closing of the external gripper jaws by energizing of solenoid 152.

C. The Stripper Chute Mechanism

Figure 2:
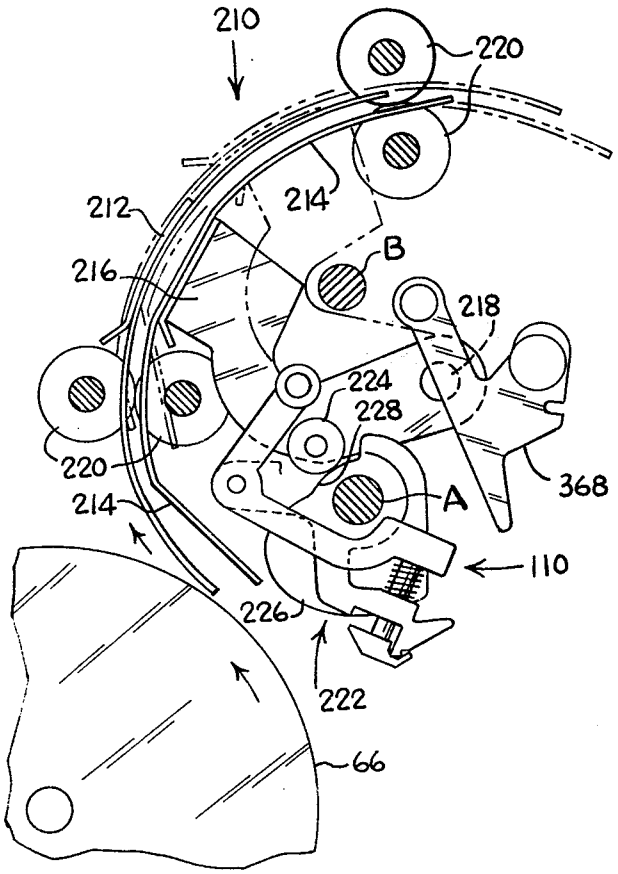
FIG. 2 is a side elevational view, taken from the same side as FIG. 1, of one set of external grippers and of one pair of stripper fingers forming a part of the stripper chute.

The stripper mechanism, shown in FIGS. 2 and 7, operates in synchronism with the external gripper mechanism to travel through a master stripping path (FIG. 11) into the proximity of the master cylinder, remove a master therefrom and divert it back into the master collection tray 54 (FIG. 1). This stripper chute mechanism, generally indicated at 210 includes a number of pairs of upper and lower stripper blades 212 and 214 mounted at spaced locations on a generally U-shaped bracket 216. The U-shaped bracket 216 is pivoted on a shaft 218, that spans frame 62. To move the stripper chute into and out of the proximity of the master cylinder, that is, between a master stripping position and a rest position shown in FIG. 2 by solid and phantom lines respectively.

The stripper chute mechanism further comprises a number of pairs of drawing rolls 220 which assist in pulling the released master through the chute and ejecting it into the collection tray.

Apparatus for moving the stripper chute through the master stripping path includes a stripper lift cam 222, fixed to shaft A for rotation therewith, which is engaged by a stripper lift cam follower 224 mounted for free rotation on the U-shaped bracket 216. When shaft A rotates in a clockwise direction as seen in FIG. 2, the stripper lift cam follower 224 rides onto a large radius lobe 226 of the stripper lift cam 222 and accordingly moves the stripper chute out of the proximity of the master cylinder. Similarly, when shaft A rotates in a counterclockwise direction, the stripper lift cam follower 224 rides onto a small radius portion 228 of stripper lift cam 222 and returns the stripper chute to the proximity of the master cylinder.

D. The External Gripper and Stripper Chute Transfer Actuator

Figure 4:
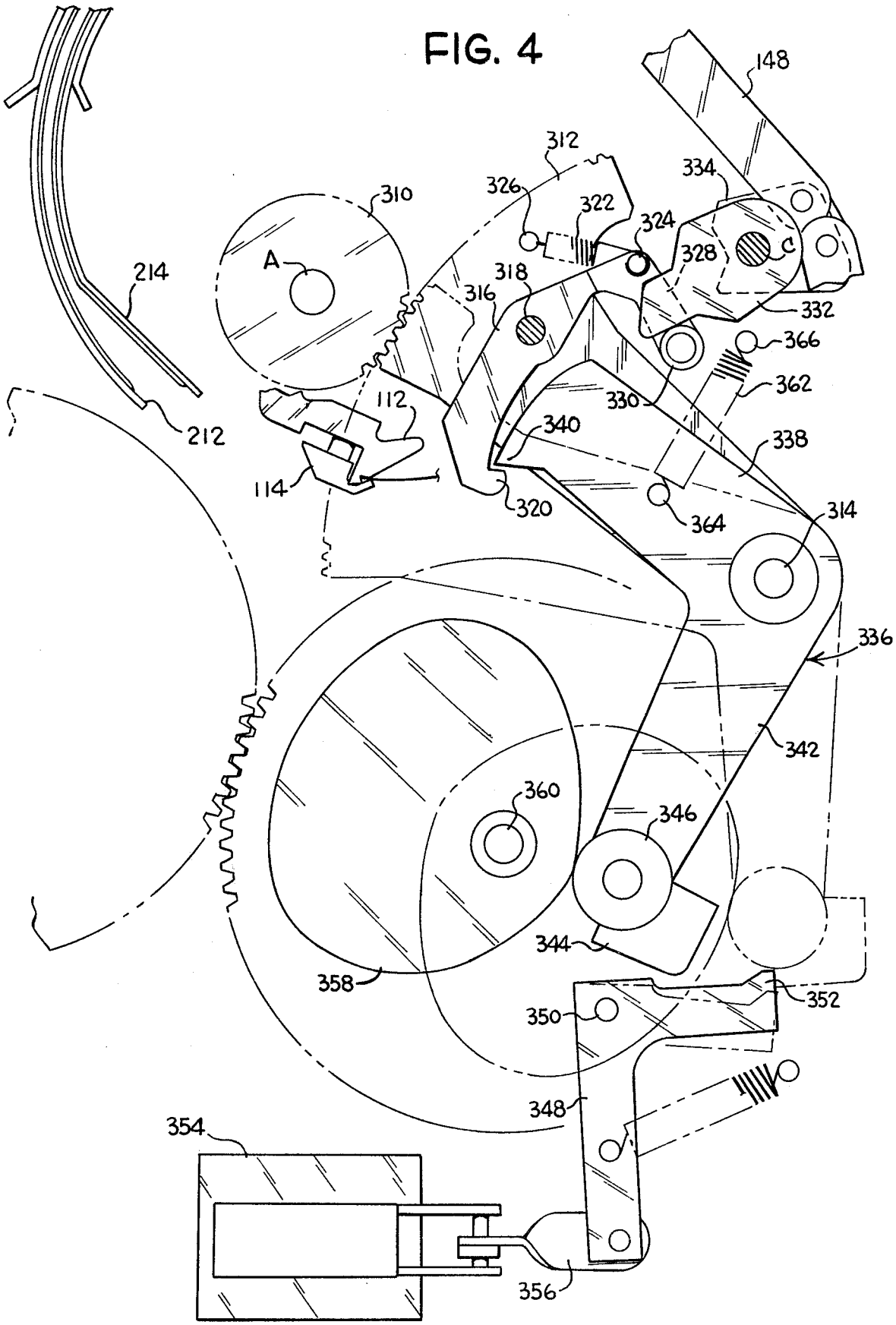
FIG. 4 is a side elevational view, taken from the same side as FIG. 1, of the transfer actuator mechanism for actuating the external grippers and the stripper chute.

The external gripper and stripper chute transfer actuator is shown in FIG. 4. This actuator operates on shaft A which extends through one end of frame 42 and carries a drive pinion 310 thereon. A sector gear 312 is pivoted on a shaft 314 mounted on the end of support frame 42 to rotate drive pinion 310 and, hence, shaft A through a range of pivoted movement.

A generally C-shaped latch 316 is mounted on a pivot shaft 318, that is fixed to sector gear 312, and has a latch finger 320 on its lower end. The C-shaped latch is urged to rotate in the counterclockwise direction by a coil spring 322 mounted in tension between two pins, one 324 carried on the C-shaped latch above pivot shaft 318 and the other 326 carried on sector gear 312. Further, the C-shaped latch 316 has an upper extension 328 on which a cam follower 330 is rotatively carried. A latch actuator cam 332 is mounted for rotation on a second secondary shaft C and engages cam follower 330. Shaft C also carries a crank arm 334, for rotation therewith, that is coupled to link 148. Accordingly, when solenoid 152 (FIG. 3) pulls link 148 downward, latch actuating cam 332 is pivoted in a clockwise direction by movement of crank arm 334, permitting C-shaped latch 316 to rotate in a counterclockwise direction about pivot shaft 318.

A main dog leg 336 is also pivoted on shaft 314 and has an upper extension 338 formed with a catch tab 340 shaped to engage latch finger 320. A lower dog leg extension 342 is formed with a latch surface 344 at its bottom margin and supports a rotatable cam follower 346.

A secondary dog leg 348 is mounted for pivoted movement on a pivot shaft 350 and is formed with a catch tab 352, shaped to engage main dog leg latch surface 344. A control solenoid 354 is coupled to secondary dog leg 348 by a link 356 and when energized, releases the main dog leg 336 by disengaging catch tab 352 and latch surface 344.

When the main dog leg 336 is released, the main dog leg cam follower 346 engages a master control cam 358, mounted for rotation on a shaft 360. A coil spring 362 mounted in tension between two pins, the first 364 mounted on main dog leg 336 and the second 366 mounted on support frame 42 urges the main dog leg 336 to rotate in the clockwise direction to insure this engagement. Shaft 360 is connected for rotation to a large driven gear 368 and is engaged by a drive gear 370 mounted to rotate with the master cylinder 66. The gear ratio between the drive and driven gears is one-toone so that master control cam 358 rotates at the same angular velocity as the master cylinder. When cam follower 346 engages rotating master control cam 358, main dog leg 336 pivots in an oscillatory manner about shaft 314.

The external gripper and stripper chute transfer mechanism functions as follows.

1. The Master Delivery and Stripper Chute Resetting Operations

When a master enters the master orientation station and trips the photocell (not shown) described above, solenoid 152 energizes to cause external grippers to grip the lead master edge. Simultaneously the energized solenoid 152, operating through crank arm 334 and latch actuating cam 332, permits the C-latch 316 to pivot in a counterclockwise direction. Shortly thereafter, solenoid 354 energizes to actuate a secondary dog leg 348, releasing main dog leg 336, and permitting cam follower 346 to engage the master control cam 358. Accordingly, main dog leg 336 oscillates for a period in a clockwise direction during which the catch tab 340 overrides the latch finger 320. When main dog leg 336 again pivots in the counterclockwise direction, it draws sector gear 312 through a similar counterclockwise arc, rotating drive pinion 310 in a clockwise direction, thus pivoting external grippers 110 through shaft A into the proximity of master cylinder 66.

When external grippers 110 are in the proximity of master cylinder 66, they open to release the lead edge of the master which then is received by the internal grippers as will be described below in detail. This release is accomplished by apparatus, illustrated in detail at progressive master releasing position in FIGS. 5A through 5C, which includes a plurality of stationary master release cams 368 each positioned to engage one cam follower 134 on the upwardly projecting extension 132 of one lower external gripper jaw actuator arm 124. Accordingly, cam followers 134 are caused to rotate in the clockwise direction about pivot shaft 128 and, thus, open the lower external gripper jaws from the upper external jaws 112. The master release cams 368 are positioned to cause the external grippers to open at the desired location which will be described below in detail.

When shaft A is rotated in the clockwise direction by transfer actuator as set forth above, the stripper chute is simultaneously moved to its rest position by action of the stripper lift cam 222 through cam follower 224 and U-shaped bracket 216 (FIG. 2).

2. The External Gripper Resetting and Stripper Chute Setting Operations

Figure 6:
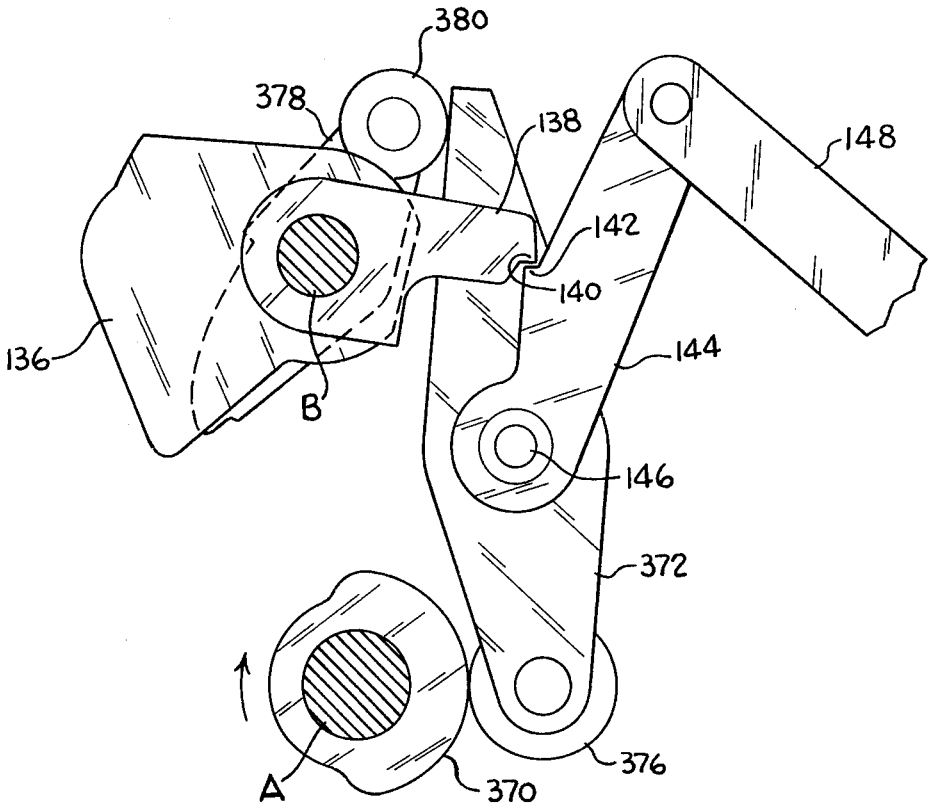
FIG. 6 is a side elevational view of an external gripper reset mechanism which resets the external grippers in an open position to receive a subsequent master in the printing run.

After a master has been delivered into the proximity of the master cylinder, the gripper jaw closing cam 136 is restored to its latched position so that the external grippers open when rotated back to their master receiving position. This restoration operation is accomplished by apparatus which is shown in FIG. 6 and which includes an external gripper reset cam 370 mounted for rotation on shaft A. An external gripper reset link 372 is pivoted on a shaft 146 and carries a reset cam follower 376 that engages external gripper reset cam 370 below shaft 374. Further, an external gripper reset crank arm 378 is non-rotatively mounted on shaft B and carries a crank arm cam follower 380 that engages external gripper reset link 372 above shaft 374.

External gripper reset cam 370 is shaped so that when external grippers are pivoted through the master delivery path, external gripper reset link 372 is pivoted in a counterclockwise direction to, in turn, pivot shaft B in a counterclockwise direction and engage cam latch projection 140 on catch surface 142. Accordingly, external gripper jaw closing cam 136 is pivoted in a counterclockwise direction.

Oscillatory motion of main dog leg 336 eventually pivots sector gear 312 back in a clockwise direction to rotate shaft A, through drive pinion 310, in a counterclockwise direction. This shaft A rotation returns external grippers 110 to their master receiving position, engaging cam follower 134 on external gripper closing cam 136 to open the gripper jaws as shown in FIG. 3.

Counterclockwise rotation of shaft A simultaneously moves the stripper chute to the master unloading position by interaction of stripper lift cam 222 with stripper lift cam follower 224 mounted on the U-shaped bracket 216.

The entire cycle of external gripper and stripper chute operation is controlled by the master control cam 358 which operates drive pinion 310 through sector gear 312 to drive shaft A.

E. The Internal Gripper Mechanism

An internal gripper mechanism is mounted relative to the master cylinder to receive the leading master edge delivered by the external gripper mechanism, to draw the master against the master cylinder surface for printing as described above and, subsequently, to release the master so that it may be stripped from the master cylinder by the stripper chute. As will be described in greater detail below, a pivotable master control cam assembly operates the internal gripper mechanism so that the master is released at a point substantially the same as that where the master is received.

Figure 8:
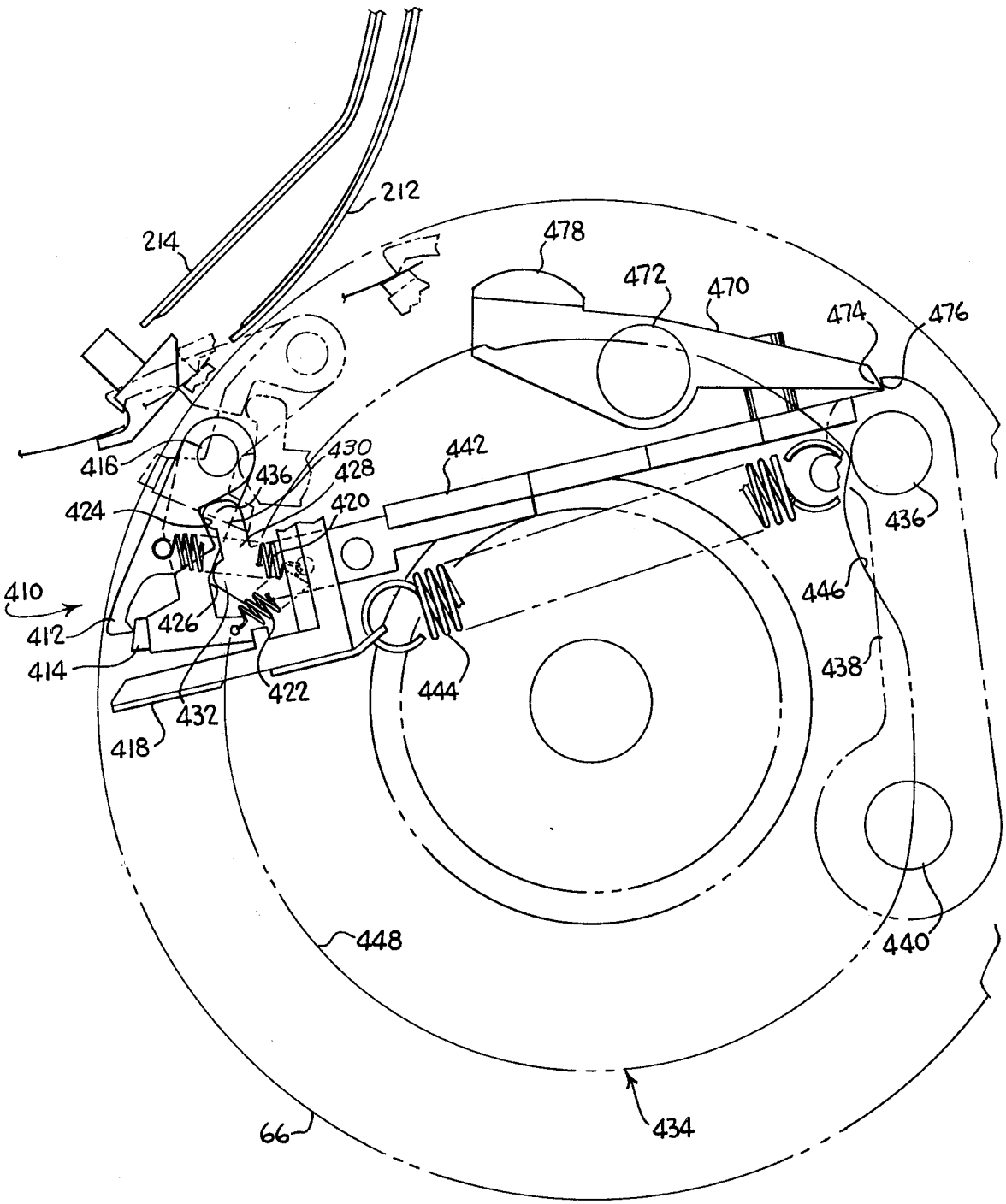
FIG. 8 is a side elevational view of the master cylinder taken from the side of the apparatus opposite that shown in FIG. 1 illustrating the internal grippers and part of the load control mechanism.
Figure 9:
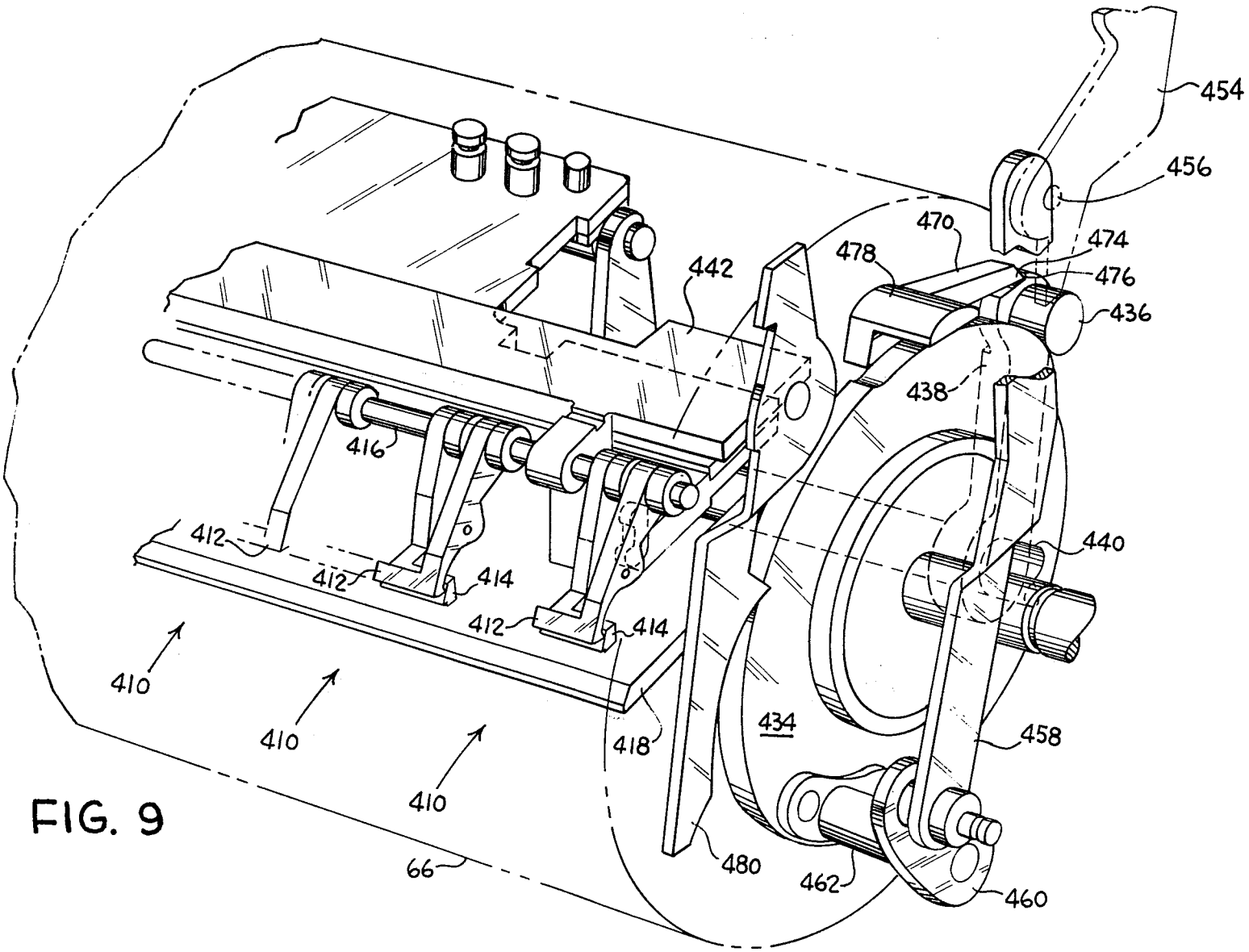
FIG. 9 is a perspective view of a number of the internal grippers and the load control cam.

As shown in FIGS. 8 and 9, which are views from the side of the apparatus opposite to those shown in FIGS. 1 through 6, the master cylinder 66 is provided with a number of internal gripper assemblies 410 each of which include upper and lower gripper jaws 412 and 414 respectively. Description of one internal gripper assembly applies to all. Both the upper and lower gripper jaws in each internal gripper assembly are mounted for pivoted movement on a shaft 416, carried in a Z-shaped bracket 418 mounted for rotation within master cylinder 66, and, thus, may be pivoted to an open position beyond the surface of master cylinder 66. However, both are urged toward the closed position, drawn within the master cylinder surface by coil springs 420 and 422 mounted in tension between the respective gripper jaws and the Z-shaped bracket 418.

The upper gripper jaw 412 has an inwardly directed cam follower surface 424 and the lower gripper jaw has a similarly inwardly directed cam follower surface 426. A single cam member 428 has upper and lower cam lobes 430 and 432 which respectively engage the upper and lower gripper jaw cam follower surfaces 424 and 426. The cam member 428 is supported for reciprocal movement in the Z-shaped bracket 418. When moved leftward, as shown by phantom lines in FIG. 8, the cam member causes the upper and lower gripper jaws to extend beyond the cam follower surface and open with respect to each other.

The cam member 428 is actuated by a pivotable, load control cam 434, non-rotatively mounted during internal gripper actuation with respect to the master cylinder on the cylinder axis. The load control cam 434 is engaged by a cam follower 436 mounted on a follower link 438, that is pivoted in master cylinder 66 on a pivot shaft 440. A push rod in the form of a broad plate 442 (FIG. 9) connects load control cam follower 436 with all cam members 428. A coil spring 444, mounted in tension between the Z-shaped bracket 418 and follower link 438, urges load control cam follower 436, push rod 442 and, hence, cam members 428 leftwardly as shown in FIG. 8.

Load control cam 434 has an actuation portion 446 which permits cam follower to move leftward to extend the internal gripper jaws beyond the master cylinder surface and to open the gripper jaws from the lower jaws. Further, the load control cam has a dwell portion 448 shaped to draw the internal gripper jaws beneath the master cylinder surface by rightward movement of cam follower 436.

The pivotable mounting of the load control cam 434 permits the angular location of internal gripper actuation to be changed during an operating cycle of the loading and unloading apparatus. In particular, the load control cam is mounted to be pivoted between master receiving and master releasing positions by a shifter assembly, shown in FIGS. 9 and 10, which includes a cam shifter solenoid 450, mounted on frame 42, coupled to a main cam shifter link 452. Link 452 is, in turn, connected to a bell crank 454, pivotably mounted on a shaft 456 extending outwardly from frame 42. A secondary cam shifter link 458 connects the bell crank 454 to the load control cam through a kidney-shaped plate 460 and rod 462 (FIG. 9). When energized, solenoid 450 pivots bell crank 454 in the counterclockwise direction, also pivoting load control cam 434 in the counterclockwise direction to the master releasing position. When the solenoid 450 is deenergized, the load control cam pivots in the clockwise direction to the master receiving position by the action of friction between the rotating master cylinder shaft and the load control cam mount.

Bell crank 454 is provided with two notches, 464 and 466, adapted to receive a pin reciprocated by a solenoid 468, to lock the shifter assembly and, hence, the load control cam in the master receiving or master releasing position.

Referring again to FIGS. 8 and 9, the internal gripper mechanism also has a lockout latch 470 mounted on a pivot shaft 472 which is fixed inside the master cylinder. Lockout latch 470 has a latch tab 474 that engages a catch notch 476 on follower link 438. Accordingly, when the follower link 438 is locked out as shown in FIG. 8, the internal grippers are held beneath the surface of master cylinder 66 and are prevented from being actuated through load control cam and cam follower 434 and 436.

Figure 10:
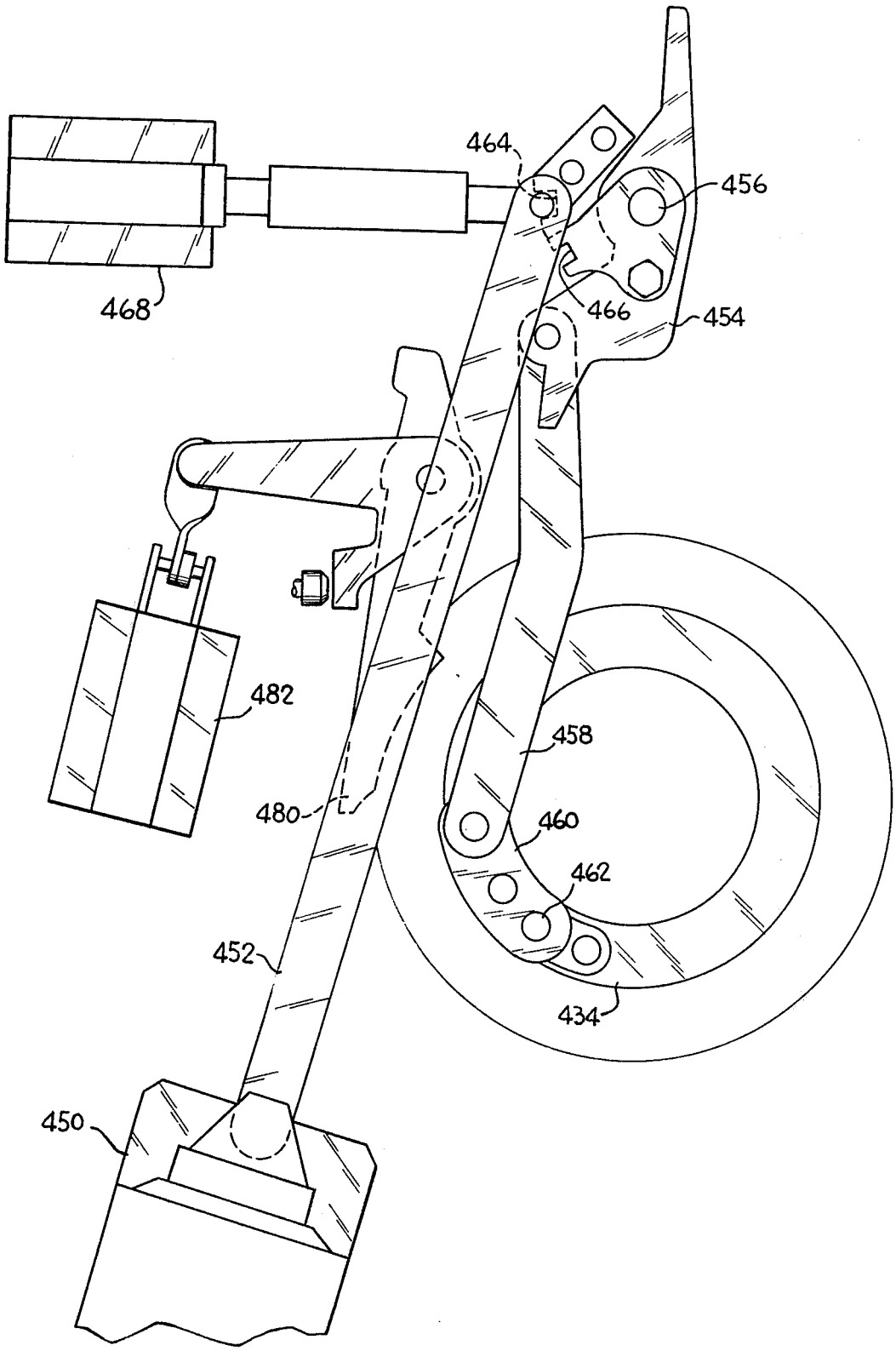
FIG. 10 is a side elevational view, also taken from the side of apparatus opposite that shown in FIG. 1, illustrating the assembly for pivoting the load control cam between master receiving and master releasing positions.

At its end opposite the latch tab 474, the lockout latch 470 has a curved, sidewardly projecting shoe 478 which may be engaged by a cycle start trip bar 480 (FIG. 9). The trip bar 480 is operated at the appropriate time by a solenoid 482 (FIG. 10). When a master release or receiving cycle of the internal grippers is desired, the cycle start bar trips shoe 478 to unlatch cam follower arm 438 and permits the load control cam follower 436 to ride on load control cam 434.

1. The Master Receiving Operation

Figure 11:
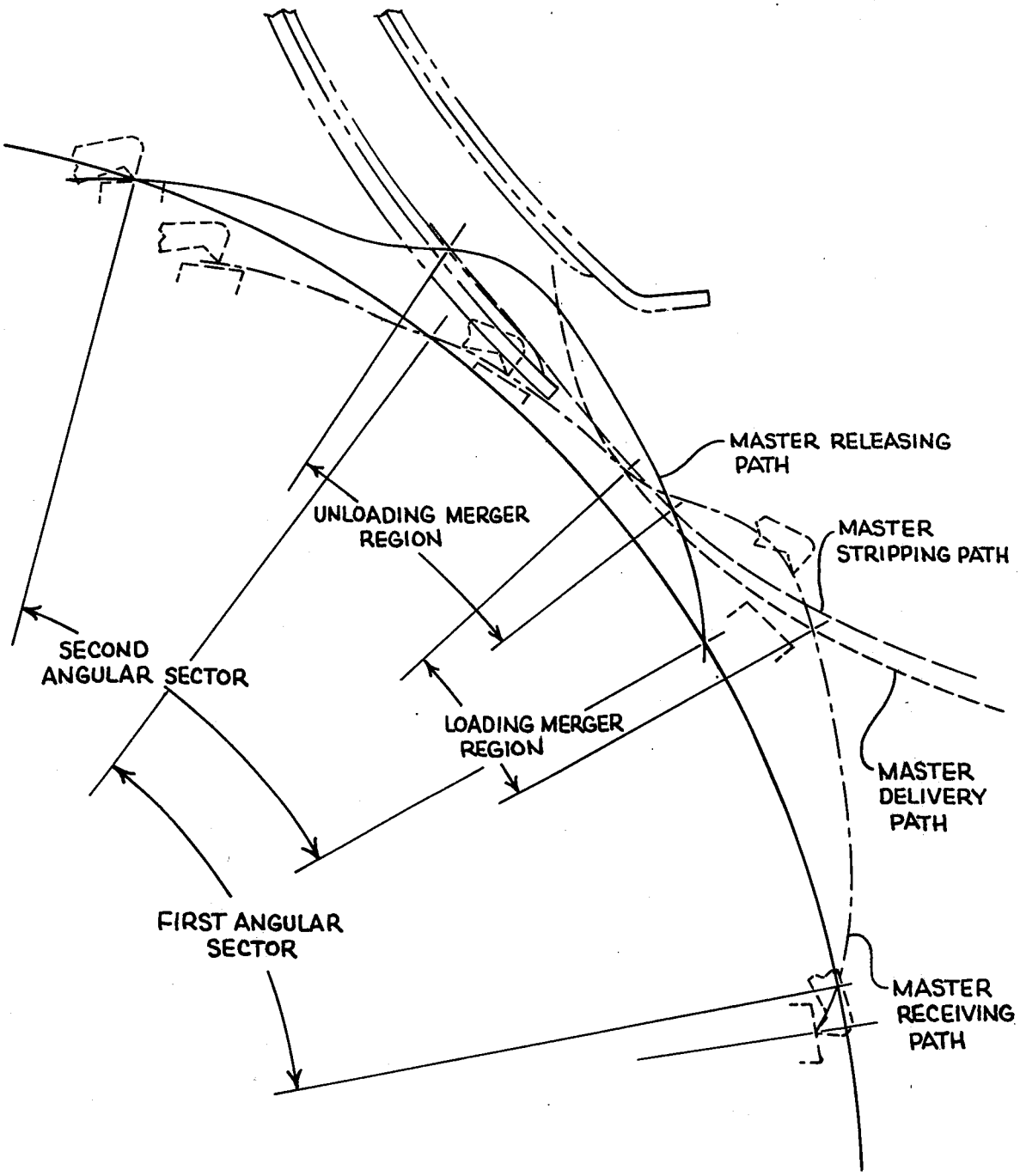
FIG. 11 is a diagrammatic representation of the paths traversed by the internal and external grippers and the stripper chute, of the first and second angular sectors of internal gripper extension, and of the loading and unloading merger regions.

When a master is to be received on the master cylinder, solenoid 450 is deenergized permitting load control cam to pivot to the master receiving position. The cycle start bar 480 is actuated by solenoid 482 to trip shoe 478 and unlock follower link 438. Accordingly, load control cam follower 436 is permitted to ride on the load control cam 434, causing internal gripper jaws 410 to traverse a master receiving path that intersects the external gripper master delivery path in a loading merger region (FIG. 11). The master receiving path is traversed during a first angular sector of cylinder rotation (FIG. 11). There the internal grippers grip the delivered master edge and return to the withdrawn position beneath the cylinder surface to draw the master against that surface. During engagement of the follower 436 on the cam dwell portion 448, the follower link is again locked out by latch 470 for the duration of the printing run.

2. The Master Releasing Operation

When a master is to be released from the master cylinder, solenoid 450 is energized to shift load control cam 434 to the master releasing position. The cycle start bar 480 is again actuated by solenoid 482 to trip shoe 478 and unlock follower link 438. The load control cam follower 436 is thus, permitted to ride on load control cam 434, now causing internal gripper jaws 410 to traverse a master releasing path that intersects the stripper chute master stripping path in an unloading merger region (FIG. 11). The master releasing path is traversed during a second angular sector of cylinder rotation shifted slightly from the first sector (FIG. 11). There the master is released into the stripper chute between upper and lower stripper blades to be unloaded from the master cylinder. Finally, after the unloading operation has been initiated, the internal gripper jaws are drawn beneath the cylinder surface and the follower link is locked out by the latch 470 until another master receiving operation is started.

This pivotable load control cam assembly permits operation of the internal grippers to grip a master received from the external grippers at one point and to release the master at substantially the same point to be stripped from the master cylinder. This relationship of loading and unloading location can best be seen in FIG. 11. In particular, the load control cam is shaped and operated so that the second angular sector, during which the internal grippers are extended, coincides at least in part with the loading merger region. Moreover, the load control cam can be operated so that the loading and unloading merger regions coincide at least in part.

E. Coordinated Motion of the External Gripper, Internal Gripper and Stripper Mechanisms to Load and Unload a Master The external gripper, internal gripper, and stripper mechanism operate in coordinated fashion to load onto and unload from a master cylinder as follows:

Prior to entry of a master into the master orientation station 50, the master cylinder rotates at idle speed. During idle, the internal grippers are held in their retracted position beneath the master cylinder surface by engaged lockout latch 470 and notched follower link 438 (FIG. 8). Main dog leg 336 is held in an extreme counterclockwise position by the catch on secondary dog leg 348 (FIG. 4). The C-shaped latch 316 is held in its extreme clockwise rotated position by the latch actuating cam 332 to prevent engagement of latch finger 320 and catch tab 340 (FIG. 4). Accordingly, the external grippers are held in their master receiving position and the stripper chute is in the proximity of the master cylinder. Moreover, the external grippers are held in their open position by gripper jaw closing cam 136. The load control cam 434 is in its master receiving position biased by rotation of the drum.

When a master enters the orientation station 50, it trips the photocell which, after a suitable delay, energizes solenoid 152 to actuate gripper jaw closing cam 136 and permit the external gripper jaws to close on the leading master edge. Simultaneously, actuation of solenoid 152 rotates latch actuating cam 332, permitting the C-shaped latch 316 to rotate in the counterclockwise direction under the influence of the coil spring 322. Moreover, solenoid 354 pivots the secondary dog leg 348 to unlatch the main dog leg 342 and permit main dog leg cam follower 346 to engage the master control cam 358.

In addition, when the photocell at the master orientation station is tripped solenoid 482 is energized to operate trip bar 480 to unlock lockout latch 470 from follower link 438.

When the lead master edge is gripped, the external grippers are moved through the master delivery path (FIG. 11) by action of the master control cam 358, the latched main dog leg 342 and C-shaped latch 316, acting through sector gear 312, drive pinion 310 and shaft A. Further, the stripper chute is moved backward, in synchronism with the external grippers, through the master stripping path (FIG. 11) out of the proximity of the master cylinder by action of the stripper lift cam 226 engaged by the stripper lift cam follower 224. Simultaneously, because of the direct drive connection between the master cylinder 66 and master control cam 358, the internal grippers traverse the master receiving path (FIG. 11) by action of the load control cam 434, cam follower 436, push rod 442, and cam member 428 which engages internal gripper jaw cam follower surfaces 424 and 426. The various actuating cams are shaped so that the internal grippers are open to receive the lead edge of the master in a loading merger region (FIG. 11) which is defined by the intersection of the master delivery path and the master receiving path. Further, the master release cam 368 is shaped and positioned so that the external grippers release this lead master edge as it is gripped by the internal grippers in the master loading merger region (FIGS. 5A through 5C).

After the delivery operation, solenoids 152 and 354 are de-energized to return the various links 144, 148 and the secondary dog leg 348 to their latching positions.

Further rotation of the master cylinder causes the internal grippers to again retract below the cylinder surface by action of the load control cam and accordingly pulls the master against the master cylinder surface for performance of the printing operation. Continued rotation of the master control cam 358 moves the external grippers out of the proximity of the master cylinder in an up position. When this extreme external gripper up position is reached, the main dog leg 336 is relatched on the secondary dog leg 348 and is held there during the printing process. The external gripper reset actuating mechanism also operates to reset the external gripper closing cam 136. Similarly, follower link 438 is locked out and the internal grippers are held in their retracted positions for the duration of the printing operation.

When the printing run has been completed, it is necessary to unload the master from the master cylinder so that a subsequent master may be again loaded. This is accomplished by energizing shifter solenoid 450, shifting load control cam 434 to its master releasing position. Simultaneously, solenoid 354 is energized to again unlatch main dog leg 336 and permit the sector gear 312, the drive pinion 310, to rotate shaft A and return the external grippers to their receiving position and move the stripper chute through the master stripping path into the proximity of the master cylinder. Since solenoid 152 has been de-energized, cam follower 330 on the C-shaped latch 316 rides on cam 332 to rotate the latch in a clockwise direction. Accordingly, latch finger 320 and catch tab 340 are disengaged and the stripper chute is held in the stripping position.

When the chute is in its stripper position, the lockout latch 470 is again tripped by cycle start bar 480 and the internal grippers are projected beyond the surface of the master cylinder by action of the load control cam 434 and cam follower 436 to traverse the master releasing path. Further, the internal grippers are opened when the lead edge of the master is between upper and lower stripper blades and in the unloading merger region defined by the intersection of the master stripping path and the master release path. A tail clip (not shown) on the master cylinder grips the trailing edge of the master to push it into the chute and into the nip of the drawing rollers 220 to unload the master into the collection tray 54.

The pivotably mounted load control cam arrangement permits extension and opening and closing of the internal gripper at angularly displaced locations to load and unload a master at substantially the same angular location. Therefore, apparatus constructed in accordance with the present invention is compact and may be housed in a modular frame for convenient association with printing and master producing instrumentalities that are also of modular construction.

Although a specific embodiment of the apparatus of the present invention has been disclosed above in detail, it is to be understood that this is only for purposes of illustration. Modifications may be made to this apparatus for loading a master onto and unloading a master from a master cylinder in a lithographic machine by those skilled in the art in order to adapt the apparatus to particular applications.

What is claimed is:

1. In a lithographic printing machine having a rotatable master cylinder for holding an imaged master of sheet materials thereon, means for applying printing fluids to the master, and means for receiving an impression from the printing fluids applied to the master; an apparatus for loading the master onto and unloading the master from the cylinder comprising:

A. gripper means external to a cylinder for gripping an edge of a master, movable through a master delivery path into the proximity of the cylinder to deliver the master edge;

B. gripper means mounted internally in the cylinder to rotate therewith, for gripping a master edge delivered into proximity of the cylinder and for later releasing the master edge, said internal gripper means being extendable beyond a surface of a cylinder, during a first angular sector of cylinder surface rotation to describe a master receiving path that intersects the master delivery path in a loading merger region, and during a second angular sector of cylinder surface rotation to describe a master release path, the second angular sector coinciding at least in part with said first angular sector of said cylinder rotation;

C. stripper means for unloading the master from the cylinder, movable into proximity of the cylinder to define a master stripping path that intersects the master release path in an unloading merger region;

D. means for actuating said external gripper means to grip a master edge, deliver the master edge to and release the master edge in the loading merger region;

E. means for selectively actuating said internal gripper means to extend beyond the cylinder surface comprising load control cam means mounted for pivoted movement between master receiving and master releasing positions, said cylinder being mounted to rotate relative to said cam means when in the master receiving and master releasing positions, and load control cam follower means for coupling said load control cam means to said internal gripper means, said load control cam means being shaped to actuate said internal gripper means to extend beyond the cylinder surface in said first angular sector when said load control cam means is in the master receiving position to grip the master edge in the loading merger region and extend beyond the cylinder surface in said second angular sector when said load control cam means is in said master releasing position to release the master edge in the unloading merger region; and F. means for moving said stripper means into the proximity of the cylinder to unload the master therefrom released in the unloading merger region.

2. The apparatus for loading a master onto and unloading a master from the master cylinder of a lithographic printing machine as claimed in claim 1 wherein said internal gripper actuator means further comprises:

A. means for selectively pivoting said load control cam means between master receiving and master releasing positions; and means for retaining said load control cam means in the master receiving and master releasing positions.

3. The apparatus for loading a master onto and unloading a master from the master cylinder in a lithographic printing machine as claimed in claim 1 wherein said internal gripper means comprises:

a plurality of opposing upper and lower internal gripper jaws, means pivotally carrying said jaws by the cylinder to be extended beyond the cylinder surface, and means to open said jaws from one another when so extended and to close said jaws together when not so extended.

4. The apparatus for loading a master onto and unloading a master from the master cylinder of a lithographic printing machine as claimed in claim 3 wherein each upper and lower internal gripper jaw further includes a cam following surface and wherein said load control cam follower means comprises:

1. a plurality of first cam members each for engaging an upper internal gripper jaw follower surface,

2. a plurality of second cam members each for engaging a lower internal gripper jaw follower surface,

3. a cam follower mounted to engage said load control cam means, and

4. push rod means for coupling said cam follower and said pluralities of first and second cam members, said pluralities of first and second cam members being shaped to a. extend each of said pluralities of opposing internal gripper jaws beyond the cylinder surface and b. open each of said opposing internal gripper jaws when actuated by said load control cam means through said push rod means and said cam follower.

5. The apparatus for loading a master onto and unloading a master from the master cylinder in a lithographic printing machine as claimed in claim 3 further comprising:

means for urging each of said opposing internal gripper jaws to their unextended, closed positions.

6. The apparatus for loading a master onto and unloading a master from the master cylinder in a lithographic printing machine as claimed in claim 1 further comprising:

means for operating said external gripper actuator means and said stripper moving means in synchronism to move the stripper means out of the proximity of the cylinder when the external gripper means moves into the proximity of the cylinder and to move the stripper means into the proximity of the cylinder when the external gripper means moves out of the proximity of the cylinder.

* * * * *